US009822945B2

(12) United States Patent
Bailly et al.

(10) Patent No.: US 9,822,945 B2
(45) Date of Patent: Nov. 21, 2017

(54) LIGHTING MODULE FOR AUTOMOBILE VEHICLES

(71) Applicant: Valeo Vision, Bobigny (FR)

(72) Inventors: Stephane Bailly, La Rouxiere (FR); Sebastian Bera, Angers (FR); Bruno Couloigner, Murs Erigne (FR)

(73) Assignee: Valeo Vision, Bobigny (FR)

( * ) Notice: Subject to any disclaimer, the term of this patent is extended or adjusted under 35 U.S.C. 154(b) by 140 days.

(21) Appl. No.: 15/001,897

(22) Filed: Jan. 20, 2016

(65) Prior Publication Data

US 2016/0215951 A1 Jul. 28, 2016

(30) Foreign Application Priority Data

Jan. 22, 2015 (FR) ..... 15 50515

(51) Int. Cl.
*F21S 8/10* (2006.01)
*F21Y 115/10* (2016.01)

(52) U.S. Cl.
CPC ..... *F21S 48/328* (2013.01); *F21S 48/10* (2013.01); *F21S 48/1104* (2013.01); *F21S 48/1159* (2013.01); *F21S 48/13* (2013.01); *F21S 48/321* (2013.01); *F21S 48/1305* (2013.01); *F21Y 2115/10* (2016.08)

(58) Field of Classification Search
CPC ..... F21S 48/328; F21S 48/10; F21S 48/1104; F21S 48/1159; F21S 48/13; F21S 48/321; F21S 48/1305; F21S 48/1742; F21Y 2115/10; F21V 14/02; F21V 21/14; F21V 29/503; F21V 29/70; F21V 29/74; F21V 14/00; B60Q 1/04; B60Q 1/045; B60Q 1/06
See application file for complete search history.

(56) References Cited

U.S. PATENT DOCUMENTS

| | | | | |
|---|---|---|---|---|
| 7,621,667 | B2 | 11/2009 | Behr et al. | |
| 8,534,888 | B2 | 9/2013 | Yasuda et al. | |
| 9,039,262 | B2 | 5/2015 | Yasuda et al. | |
| 9,061,628 | B2 * | 6/2015 | Moisy | B60Q 1/0064 |
| 9,568,160 | B2 * | 2/2017 | Turley, Jr. | F21S 48/1752 |
| 2008/0117647 | A1 | 5/2008 | Behr et al. | |
| 2012/0063156 | A1 | 3/2012 | Yasuda et al. | |
| 2013/0235606 | A1 | 9/2013 | Yasuda et al. | |

(Continued)

FOREIGN PATENT DOCUMENTS

| | | |
|---|---|---|
| DE | 102004062990 | 7/2006 |
| DE | 102012106313 | 1/2014 |
| DE | 102012106314 | 1/2014 |

(Continued)

*Primary Examiner* — Bao Q Truong
(74) *Attorney, Agent, or Firm* — Jacox, Meckstroth & Jenkins

(57) ABSTRACT

A lighting module for automobile vehicles, including at least one optical module adapted to produce a first cut-off beam; a support plate for a heatsink; the heatsink adapted to receive the optical module; wherein the support plate includes a first surface; the heatsink includes rotational adjustment means adapted to enter into contact with the first surface of the support plate; and to pivot about a particular rotation axis so as to position the first cut-off beam produced by the optical module at a reference position.

20 Claims, 8 Drawing Sheets

(56) References Cited

U.S. PATENT DOCUMENTS

| | | | |
|---|---|---|---|
| 2015/0198325 | A1 | 7/2015 | Mugge et al. |
| 2015/0204499 | A1 | 7/2015 | Pawliczek et al. |

FOREIGN PATENT DOCUMENTS

| | | |
|---|---|---|
| DE | 102012107432 | 5/2014 |
| EP | 2428725 | 3/2012 |
| WO | 2014009185 | 1/2014 |

* cited by examiner

LIGHTING MODULE FOR AUTOMOBILE VEHICLES

CROSS-REFERENCE TO RELATED APPLICATIONS

This application claims priority to the French application 1550515 filed Jan. 22, 2015, which application is incorporated herein by reference and made a part hereof.

BACKGROUND OF THE INVENTION

1. Field of the Invention

The present invention concerns a lighting module for automobile vehicles. It finds one particular but nonlimiting application in lighting devices such as automobile vehicle headlights.

2. Description of the Related Art

A lighting module for automobile vehicles is described in the patent application WO2014/009185A1, which is equivalent to U.S. Patent Publication 2015/0204499. It includes:

at least one optical module adapted to produce a first beam;

a support plate for a heatsink; and a heatsink adapted to receive the optical module and including cooling fins.

A support plate is of spherical shape. It includes a slide for an adjustment in a first given direction of the heatsink in the support plate and a first groove perpendicular to the slide for an adjustment in a second given direction of the heatsink in the support plate.

The lighting module further includes:

a blocking element that is adapted to be sandwiched between the heatsink and the support plate; and means for fixing the heatsink to the support plate.

According to the above prior art, the lighting module comprises five modules, five associated heatsinks, five associated support plates, five blocking elements and five fixing means.

This makes it possible to produce a band of light comprising five light beams. Combined with an optical module making it possible to produce a cut-off beam a portion of which is oblique, the band of light makes it possible to produce a low beam photometric function. The five beams must be adjusted relative to one another along a vertical axis and with the cut-off beam along a horizontal axis, which is possible thanks to the two possible directions for moving the heatsink in the support plate.

A drawback of the above prior art is that this lighting module comprises a large number of mechanical parts that makes the assembly of the lighting module complex and time-consuming.

In this context, the present invention aims to remove the disadvantage referred to above.

SUMMARY OF THE INVENTION

To this end, the invention proposes a lighting module for automobile vehicles, including:

at least one optical module adapted to produce a first cut-off beam;

a support plate for a heatsink;

a heatsink adapted to receive the optical module;

characterized in that:

the support plate includes a first surface;

the heatsink includes rotational adjustment means adapted:

to enter into contact with the first surface of the support plate; and to pivot about a particular rotation axis so as to position the first cut-off beam produced by the optical module at a reference position.

Accordingly, as will emerge in detail hereinafter, assembling the elements of the lighting module is simplified because the number of mechanical parts has been reduced and there remains only one adjustment of the heatsink relative to the support plate about a given rotation axis.

In accordance with nonlimiting embodiments, the lighting module may further include one or more of the following additional features:

In one nonlimiting embodiment, the optical module includes a first reflector provided with at least one light source.

In one nonlimiting embodiment, the first cut-off beam is a cut-off beam at least one portion of which is flat.

In one nonlimiting variant embodiment, the cut-off of the first cut-off beam is an entirely flat upper cut-off.

In one nonlimiting embodiment, the rotational adjustment means include two fins for guiding the heatsink, notably distributed on respective opposite sides of the cooling fins.

The shapes of the first surface and the adjustment means are advantageously complementary. In one nonlimiting embodiment, the first surface and the rotational adjustment means are of cylindrical shape with a circular section.

In one nonlimiting embodiment, the support plate further includes at least one slide; and the heatsink further includes a male pivot pin adapted to be inserted in the slide of the support plate.

In one nonlimiting variant embodiment, the support plate includes two slides; and the heatsink includes two male pivot pins adapted to be inserted in respective ones of the slides.

In one nonlimiting embodiment, the heatsink further includes a first interface area adapted to cooperate with an adjustment tool so as to actuate the rotation of the adjustment means about the rotation axis.

In one nonlimiting embodiment, the support plate further includes a surface provided with an aperture situated in front of the first surface; and the first interface area is disposed at the level of the aperture after the contact between the rotational adjustment means of the heatsink and the first surface of the support plate.

In one nonlimiting example, the surface includes a U-shaped contour that forms the aperture.

In one nonlimiting embodiment, the heatsink further includes an additional interface area adapted to cooperate with an adjustment tool so as to actuate the rotation of the adjustment means about the rotation axis.

In one nonlimiting embodiment, the support plate further includes a screw pillar; and a fin for guiding the heatsink is further adapted to receive fixing means inserted in the screw pillar of the support plate.

In one nonlimiting embodiment, the support plate further includes a second surface facing the first surface, the two surfaces forming a groove for guiding the means for rotational adjustment of the heatsink.

In one nonlimiting embodiment, the second surface is of cylindrical shape with circular section.

In one nonlimiting embodiment, the support plate is further adapted to receive an additional optical module adapted to produce a second cut-off beam.

In one nonlimiting embodiment, the optical module includes a second reflector provided with at least one light source.

In one nonlimiting embodiment, the second cut-off beam is a cut-off beam a portion of which is oblique. Alternatively, the second cut-off beam may be a flat cut-off beam.

In one nonlimiting embodiment, the reference position corresponds to a horizontal part of the second cut-off beam.

In one nonlimiting embodiment, the reference position corresponds to a position in which a part of the cut-off of the first beam is substantially superposed on a part of the cut-off of the second beam, notably if the beams are projected onto a screen disposed at 25 m from the lighting module. The superposition accommodates a tolerance of plus or minus 0.5° of the first beam relative to the second beam.

In one nonlimiting embodiment, the first cut-off beam and the second cut-off beam are adapted to provide conjointly a first low beam photometric function.

In one nonlimiting embodiment, the heatsink further includes at least one printed circuit board to which at least one light source is connected.

In one nonlimiting embodiment, the at least one light source is a semi-conductor emitter chip.

In one nonlimiting embodiment, a semiconductor emitter chip forms part of a light-emitting diode.

Also proposed is a lighting device for automobile vehicles including a lighting module having any one of the foregoing features.

These and other objects and advantages of the invention will be apparent from the following description, the accompanying drawings and the appended claims.

BRIEF DESCRIPTION OF THE ACCOMPANYING DRAWINGS

The invention and its various applications will be better understood on reading the following description and examining the accompanying figures.

Figure 1:
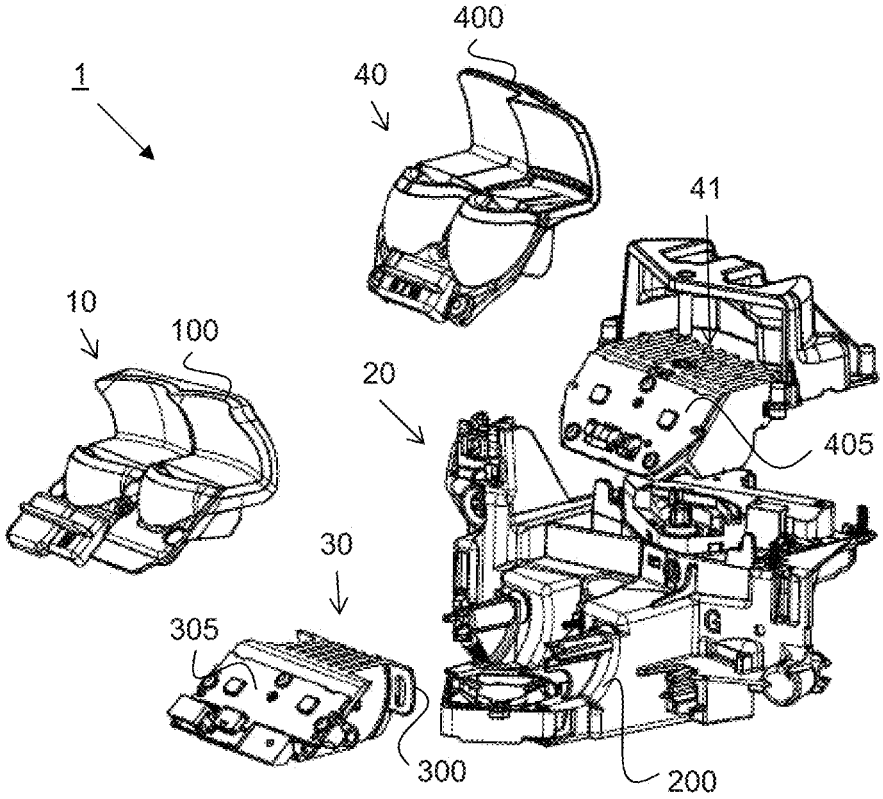
FIG. 1 is an exploded view of a lighting module conforming to one nonlimiting embodiment of the invention for automobile vehicles, the lighting module including at least an optical module, a support plate and a heatsink.
Figure 2:
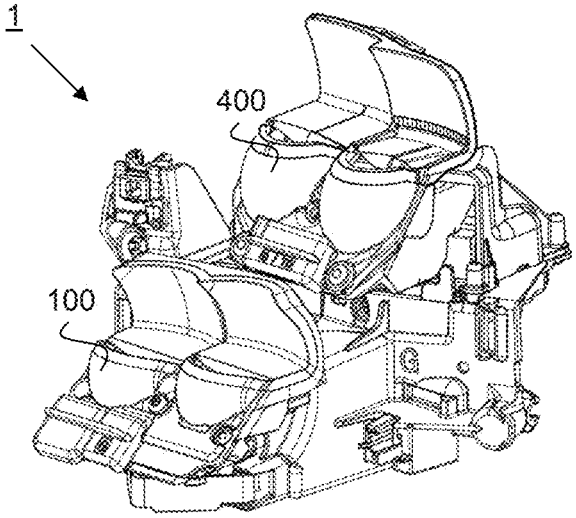
FIG. 2 represents the lighting module from FIG. 1 when assembled, conforming to one nonlimiting embodiment.
Figure 4A:
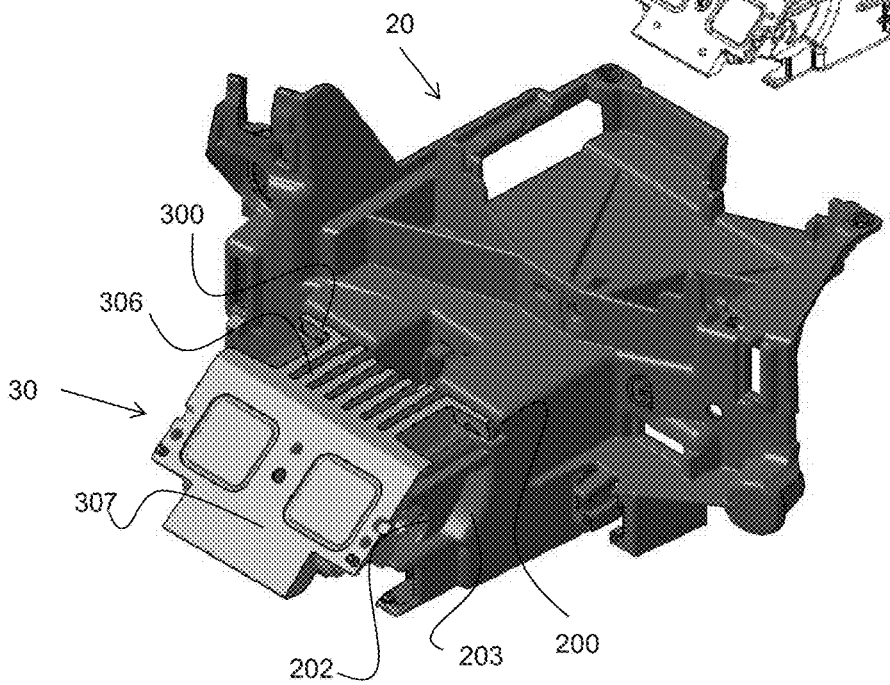
Figure 4B:
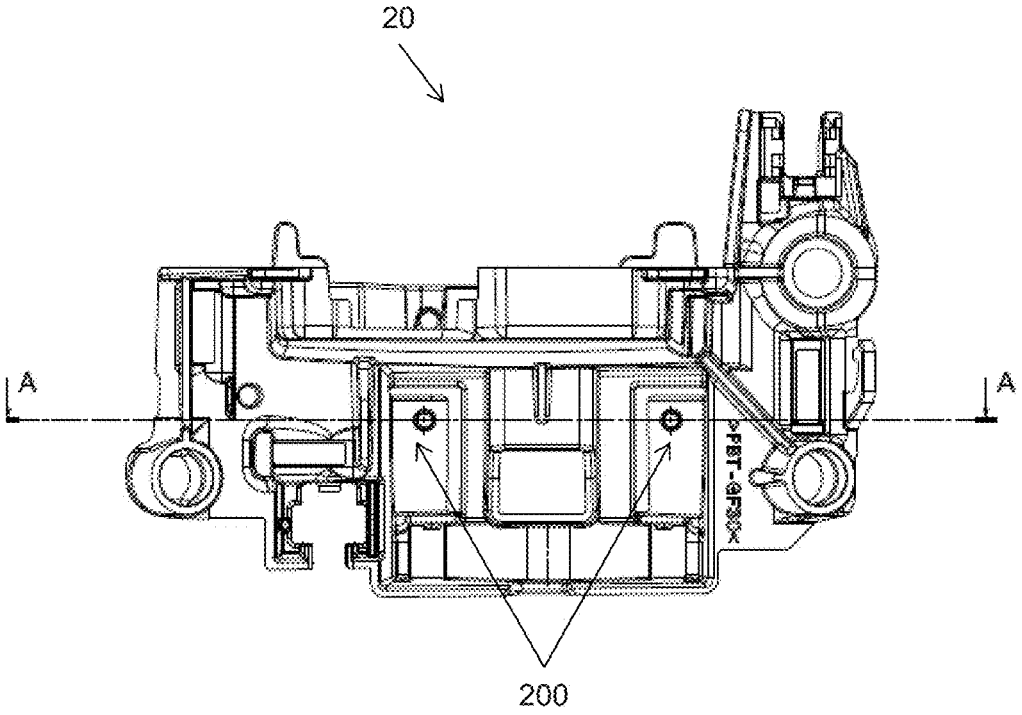
Figure 5:
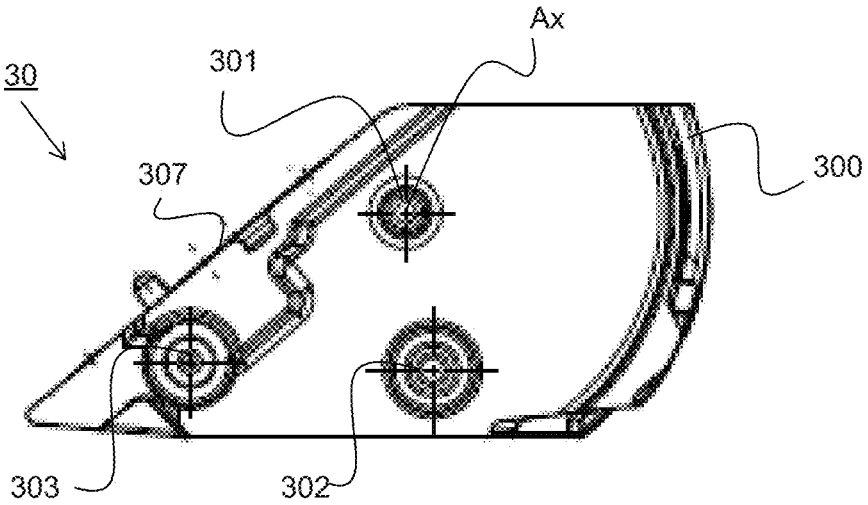
Figure 6:
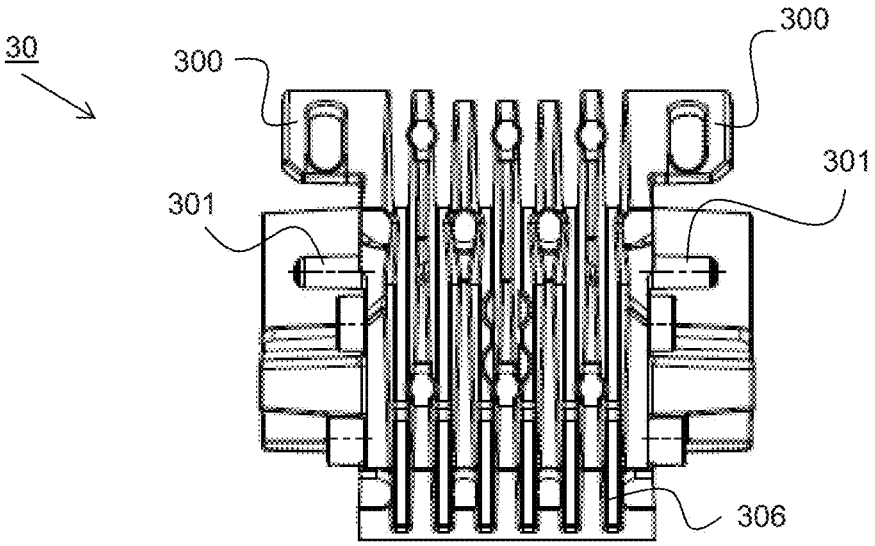
Figure 7:
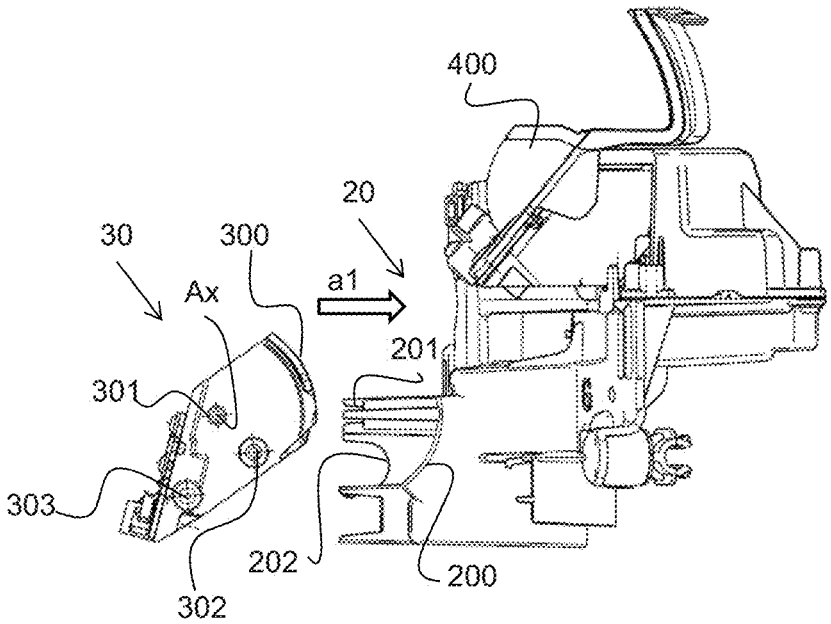
Figure 8:
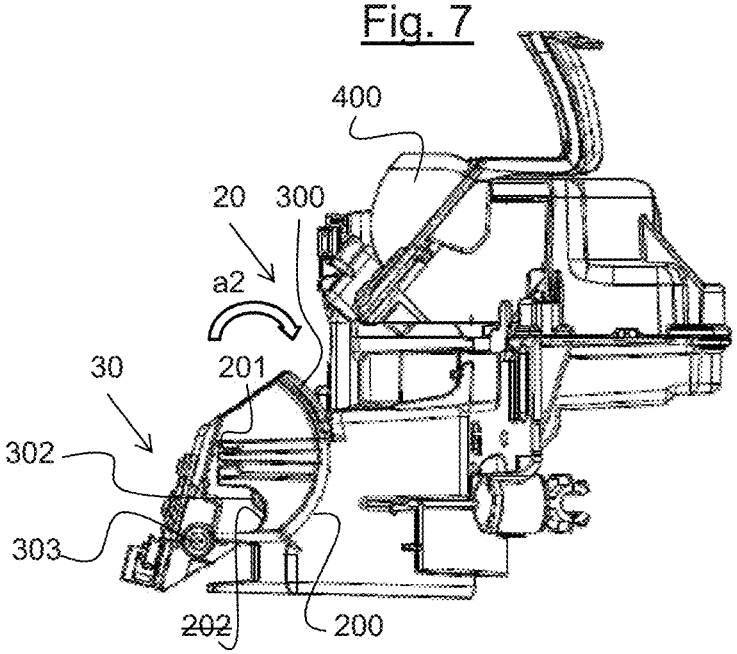
Figure 9:
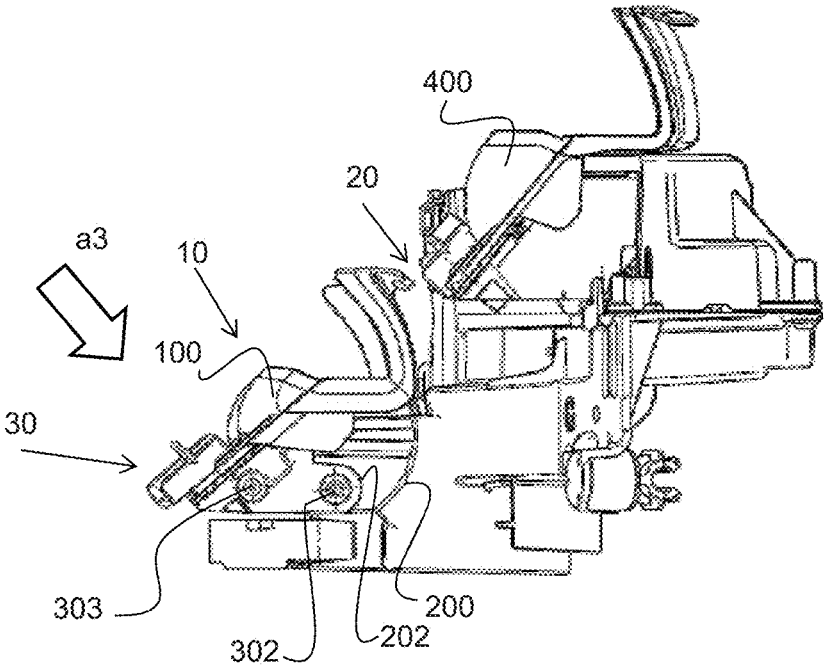
Figure 10:
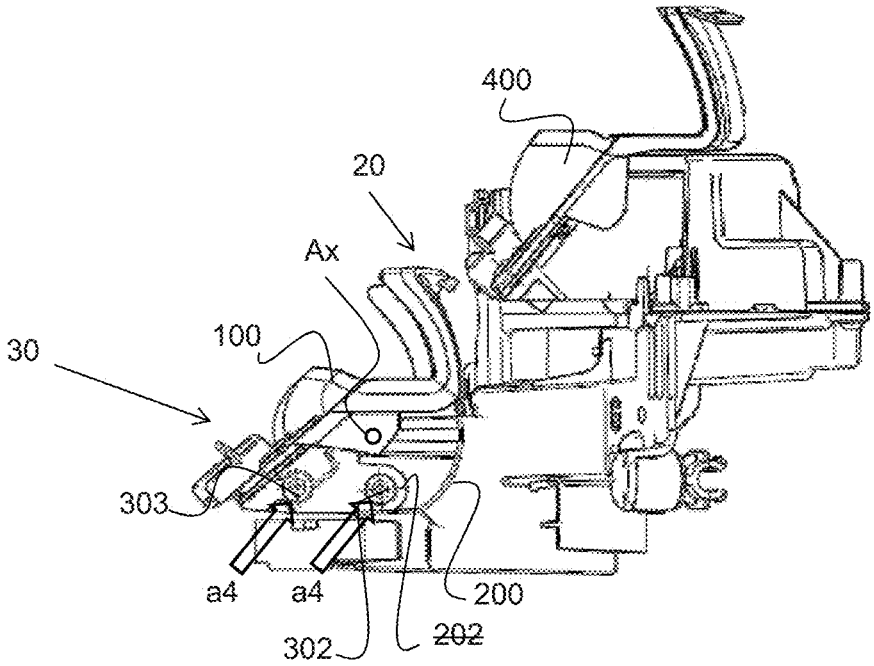
Figure 11:
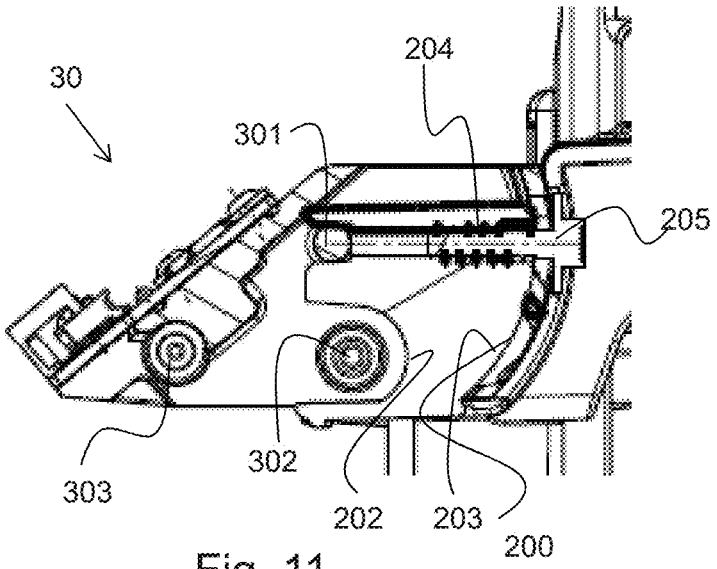
Figure 12:
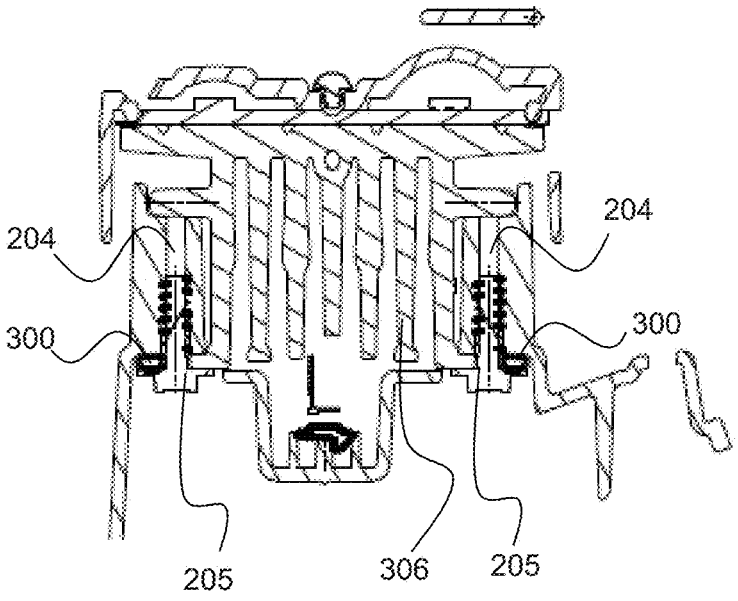
Figure 13:
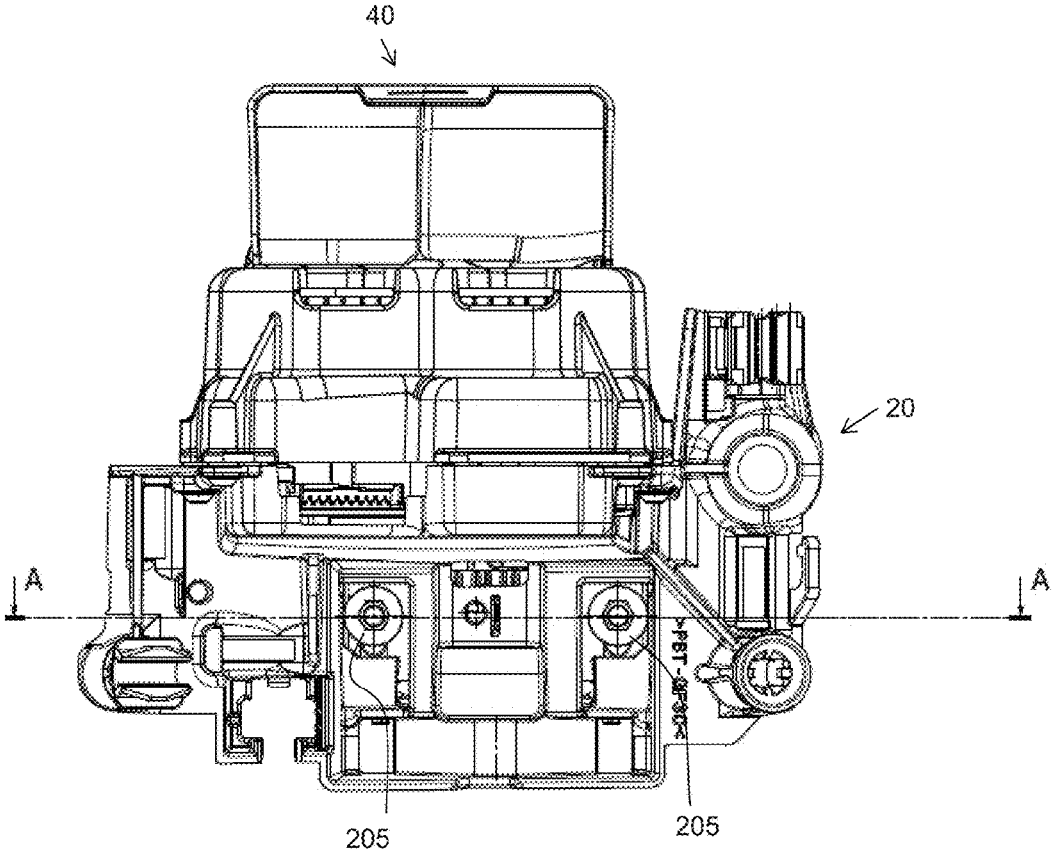

FIG. 4*a* represents the support plate of the lighting module with the heatsink form FIGS. 1 and 2, conforming to one nonlimiting embodiment;

FIG. 4*b* represents the rear face of the support plate of the lighting module from FIGS. 1 and 2, conforming to one nonlimiting embodiment;

FIG. 5 represents a profile view of the heatsink of the lighting module from FIGS. 1 and 2, conforming to one nonlimiting embodiment;

FIG. 6 represents a rear view of the heatsink of the lighting module from FIGS. 1 and 2, conforming to one nonlimiting embodiment;

FIG. 7 represents a profile view of the heatsink and the support plate of the lighting module from FIGS. 1 and 2 in a first assembly step, conforming to one nonlimiting embodiment;

FIG. 8 represents a profile view of the heatsink and the support plate of the lighting module from FIGS. 1 and 2 in a second assembly step, conforming to one nonlimiting embodiment;

FIG. 9 represents a profile view of the heatsink and the support plate of the lighting module from FIGS. 1 and 2 in a third assembly step, conforming to one nonlimiting embodiment;

FIG. 10 represents a profile view of the heatsink and the support plate of the lighting module from FIGS. 1 and 2 in a fourth assembly step, conforming to one nonlimiting embodiment;

FIG. 11 represents a profile view of the heatsink and the support plate of the lighting module from FIGS. 1 and 2 in a fifth assembly step, conforming to one nonlimiting embodiment;

FIG. 12 represents a top view of the heatsink and the support plate of the lighting module from FIGS. 1 and 2 in a fifth assembly step, conforming to one nonlimiting embodiment; and FIG. 13 represents a rear view of the heatsink and the support plate of the lighting module from FIGS. 1 and 2 in a fifth assembly step, conforming to one nonlimiting embodiment.

DETAILED DESCRIPTION OF THE PREFERRED EMBODIMENTS

Elements appearing in different Figures that are identical in structure or in function keep the same references, unless otherwise specified.

The lighting module 1 in accordance with the invention for automobile vehicles V is described with reference to FIGS. 1 to 13.

By automobile vehicle is meant any type of motorized vehicle.

A lighting device (not shown) for automobile vehicles V includes the lighting module 1. In one nonlimiting example, the lighting device is a headlight.

The lighting module 1 comprises:

at least one optical module 10 adapted to produce a first cut-off beam 101;

a support plate 20 for a heatsink 30;

a heatsink 30 adapted to receive the optical module 10.

As shown in FIGS. 1 and 2, in one nonlimiting embodiment, the lighting module 1 further comprises:

an additional optical module 40 adapted to produce a second cut-off beam 401;

a heatsink 41 adapted to receive the additional optical module 40.

FIG. 1 shows an exploded view of the lighting module 1 while FIG. 2 represents the lighting module 1 in which all the elements are assembled.

The various elements of the lighting module 1 are described in detail hereinafter.

Optical Module 10

In one nonlimiting embodiment, the optical module 10 includes a first reflector 100 provided with at least one light source.

Likewise, in one nonlimiting embodiment, the additional optical module 40 includes a second reflector 400 provided with at least one light source.

In one nonlimiting embodiment, the optical modules 10 and 40 include a plurality of light sources.

In one nonlimiting embodiment, the light sources are semiconductor emitter chips.

In one nonlimiting variant embodiment, a semiconductor emitter chip forms part of a light-emitting diode.

By light-emitting diode is meant any type of light-emitting diode whether they are, in nonlimiting examples, LED (light-emitting diodes), OLED (organic LEDs), AMOLED (active-matrix-organic LEDs) or FOLED (flexible OLEDs).

Each optical module 10 and 40 further includes at least one printed circuit board 305 and 405, respectively, also referred to as PCBs, to which the light sources are connected.

Each printed circuit board 305 and 405 is disposed on the respective radiator or heatsink 30 and 41 associated with each optical module 10 and 40.

In one nonlimiting embodiment, the first cut-off beam 101 and the second cut-off beam 401 are adapted to produce conjointly a first low beam photometric function f1.

In one nonlimiting embodiment, the first cut-off beam 101 is a cut-off beam of which at least one portion is flat.

In a first nonlimiting variant embodiment, the cut-off of the first cut-off beam 101 is an entirely flat upper cut-off and the second cut-off beam 401 is a cut-off beam a portion of which is oblique. In this case, the first cut-off beam 101 is of "flat" type and the second cut-off beam 401 is of "kink" type.

In a second nonlimiting variant embodiment, the above may be reversed. The cut-off of the second cut-off beam 401 is an entirely flat upper cut-off and the first cut-off beam 101 is a cut-off beam a portion of which is oblique. In this case, the first cut-off beam 101 is of "kink" type and the second cut-off beam 401 is of "flat" type.

In a third nonlimiting variant embodiment, the cut-off of the first cut-off beam 101 is an entirely flat upper cut-off and the second cut-off beam 401 is also a flat cut-off beam.

Figure 3:
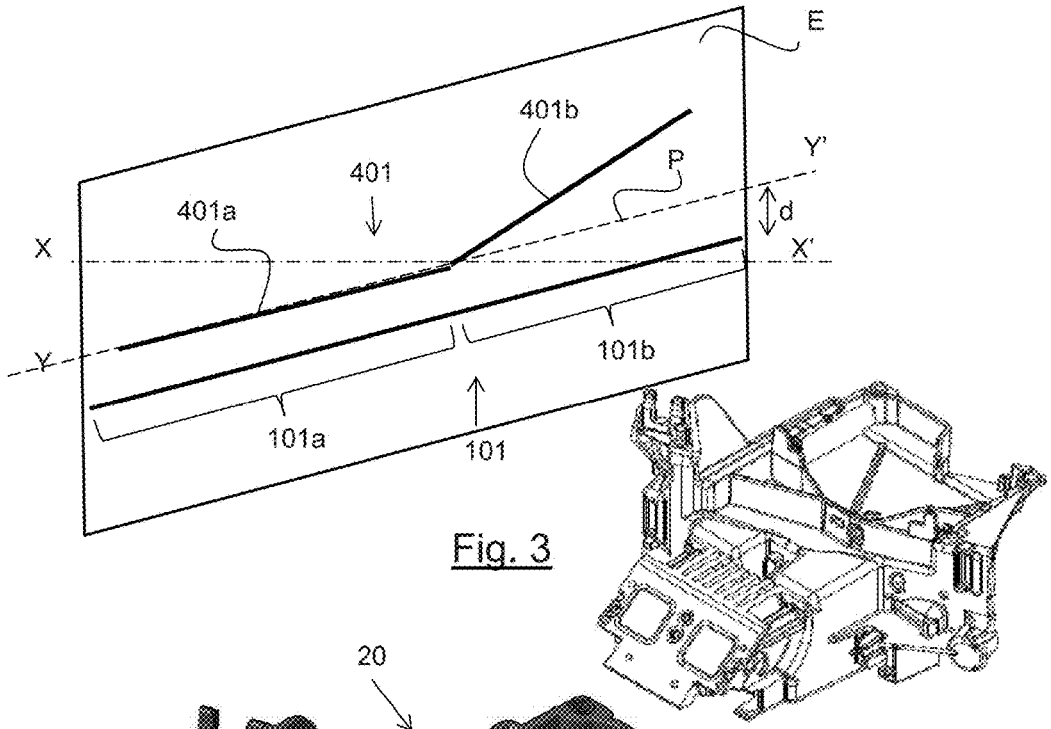
FIG. 3 is a diagram of a screen onto which are projected a first cut-off beam from the optical module from FIGS. 1 and 2 and a second cut-off beam from an additional module, conforming to one nonlimiting embodiment.

The first variant embodiment is shown in FIG. 3.

FIG. 3 shows a screen E disposed at 25 meters from the lighting module 1 and onto which the first and second cut-off beams 101 and 401 are projected.

The first cut-off beam 101 comprises two flat portions 101*a* and 101*b*. The first cut-off beam 101 therefore includes an entirely flat upper cut-off.

The second cut-off beam 401 includes a portion 401*a* that is flat and a portion 401*b* that is oblique.

In the nonlimiting example shown, the two portions 101*a* and 101*b* of the first cut-off beam 101 are situated at a distance d from a reference position P.

As will emerge hereinafter, the assembly comprising the heatsink 30 and the support plate 20 will make it possible to position the first cut-off beam 101 produced by the optical module 10 at the reference position P. The assembly will make it possible to adjust the position of the first cut-off beam 101 so that the distance d is equal to 0. The position of the first beam will be adjustable along the horizontal axis Y-Y' shown in FIG. 3.

In one nonlimiting embodiment, as shown in FIG. 3, the reference position P corresponds to a position in which a portion 101*a* of the cut-off of the first beam is substantially superposed on a portion 401*a* of the cut-off of the second beam 401, notably when the beams 101 and 401 are projected onto the screen E 25 m from the lighting module 1.

In one nonlimiting embodiment, the superposition supports a tolerance of plus or minus 0.5° of the first cut-off beam 101 relative to the second cut-off beam 401.

In the nonlimiting example shown, the reference position P corresponds to a horizontal portion 401*a* of the second cut-off beam 400.

Support Plate 20

The support plate 20 in accordance with one nonlimiting embodiment is shown in FIGS. 4*a*, 4*b* and 7 to 10. In FIG. 4 is also shown the heatsink 30 that is positioned in the support plate 20.

The support plate 20 includes a first surface 200.

This first surface 200 in conjunction with the means for adjusting the heatsink (described hereinafter) will make it possible to pivot the heatsink 30 in rotation so as to adjust the position of the first cut-off beam 101 to the reference position P described above.

In one nonlimiting embodiment, the first surface 200 is of cylindrical shape with circular section. This makes it possible to optimize the area of contact under the cooling fins 306 as shown in FIGS. 7 to 10.

In the nonlimiting example shown in FIGS. 4*a* and 4*b* (rear view), the support plate 20 includes two first surfaces 200.

In nonlimiting variant embodiments, the support plate 20 further includes:

at least one slide 201 (shown in FIG. 7 for example);

at least one surface 202 provided with an aperture situated in front of the first surface 200;

at least one screw pillar 204 (shown in FIG. 13).

In the nonlimiting example shown in FIG. 4*a*, the support plate 20 includes:

two slides 201;

two surfaces 202 provided with an aperture;

two screw pillars 204.

It will be noted that a slide 201 is provided with a rear abutment.

It will be noted that the aperture enables access to be had to the first interface area 302 (described hereinafter) after a manual rotation.

In one nonlimiting embodiment, the surface 202 includes a U-shaped contour that forms the aperture.

The slide 201 is adapted to receive a male pivot pin 301 (described hereinafter) of the heatsink 30. It will make it possible to immobilize the heatsink vertically and longitudinally at a given position and in conjunction with the male pin 301 will enable rotation of the heatsink 30 about a rotation axis Ax passing through the center of the male pin 301. The assembly comprising the slide 201 and the male pin 301 therefore forms a pivot connection.

The screw pillar 204 is adapted to receive fixing means 205 (described hereinafter) for immobilizing the heatsink 30 in position.

In one nonlimiting embodiment, the support plate 20 further includes a second surface 203 facing the first surface 200, the two surfaces 200, 203 forming a groove for guiding the rotational adjustment means or guide fins 300 (described hereinafter) of the heatsink 30.

In one nonlimiting embodiment, the second surface 203 is of cylindrical shape with circular section.

Heatsink 30

The heatsink 30 is shown in FIG. 5 (profile view) and FIG. 6 (rear view).

The heatsink 30 includes:

a location 307 for the printed circuit board 305. The location 307 also makes it possible to receive the optical module 10 that is positioned above the printed circuit board 305.

In one nonlimiting embodiment, the heatsink 30 further includes cooling fins 306 adapted to cool the components of the printed circuit board 305.

The heatsink 30 further includes rotational adjustment means 300 adapted:

to enter into contact with the first surface 200 of the support plate 20; and to pivot about a particular rotation axis Ax so as to position the first cut-off beam 101 produced by the optical module 10 at a reference position P.

It will be noted that the shapes of the first surface 200 and of the adjustment means 300 are complementary to each other.

In one nonlimiting embodiment, the rotational adjustment means 300 are of cylindrical shape with circular section as shown in FIG. 5.

In one nonlimiting embodiment, the rotational adjustment means 300 include two fins 300 for guiding the heatsink 30, notably arranged on respective opposite sides of the cooling fins 306.

These guide fins 300 will enter into contact with the first surface 200 and the support plate 20 and will make it possible to adjust the position of the first cut-off beam 101.

These guide fins 300 also make possible improved heat dissipation from the heatsink 30 because the flow of air produced by a fan (not shown) coupled to the heatsink 30 will cross the guide fins 300 vertically.

one nonlimiting embodiment, at least one guide fin 300 of the heatsink 30 is further adapted to receive fixing means 205 (described hereinafter) inserted in the screw pillar 204 of the support plate 20. In the example shown in FIG. 6, the heatsink 30 includes two guide fins 300 each adapted to receive fixing means 205. The guide fins 300 each include an opening provided for this purpose.

In one nonlimiting embodiment, the rotational adjustment means 300 further include rear cooling fins 306 that have a cylindrical profile. This makes it possible to optimize the shape of the cooling fins 306 relative to the available space.

In nonlimiting embodiments, the heatsink 30 further includes:

at least one male pivot pin 301 adapted to be inserted in the slide 201 of the support plate 20 (as explained above).

a first interface area 302 adapted to cooperate with an adjustment tool, for example a screwdriver, so as to actuate the rotation of the adjustment means 300 about the rotation axis Ax by angles of small amplitudes and therefore to make possible a fine adjustment.

In the nonlimiting example shown in FIG. 6, the heatsink 30 includes: two male pivot pins 301 arranged one on each side of the heatsink 30; two first interface areas 302 arranged one on each side of the heatsink 30.

In one nonlimiting embodiment, the heatsink 30 further includes at least one additional interface area 303 adapted to cooperate with an adjustment tool so as to actuate the rotation of the adjustment means 300 about the rotation axis Ax. This interface area 303 in conjunction with the first interface area 302 makes it possible to effect a fine rotation of the heatsink 30 when it is in position in the support plate 20.

In the nonlimiting example shown in FIG. 6, the heatsink 30 includes two additional interface areas 303.

Having described all of the elements of the lighting module 1, the steps of assembling the elements are described hereinafter with reference to FIGS. 7 to 13.

In the nonlimiting embodiment shown, the assembly of the elements of the lighting module 1 makes it possible to position the "flat" type first cut-off beam 101 relative to the "kink" type second cut-off beam 401.

These figures do not show the assembly of the second heatsink 41 and the second optical module 40 to the support plate 20.

In the nonlimiting example shown in the figures, these two elements 41 and 40 are assembled beforehand.

In the nonlimiting example shown in the figures, these two elements, the second heatsink 41 and the second optical module 40, are assembled beforehand.

In one nonlimiting embodiment, this first step is effected manually by an operative.

The heatsink 30 equipped only with the PCB, i.e. without the optical module 10, is inserted in the support plate 20 in a horizontal direction as indicated by the arrow a1.

The insertion is effected by inserting each male pivot pin 301 in the associated slide 201 of the support plate 20.

Each male pivot pin 301 therefore slides along the slide 201 and at the end of travel reaches the rear abutment of the slide 201.

As shown in FIG. 7, the guide fins 300 enter into contact with the first cylindrical surface 200 of the support plate 20 and because of their cylindrical shape (in the nonlimiting embodiment shown) the surface of the guide fins 300 substantially espouses the cylindrical first surface 200.

The first interface area 302 is disposed at the level of the aperture following the contact between the rotational adjustment means 300 of the heatsink 30 and the first surface 200 of the support plate 20.

This ensures that the first interface area 302 is accessible regardless of the position of the heatsink 30.

FIG. 8 shows the assembly of the heatsink 30 to the support plate 20 in accordance with a second assembly step.

In one nonlimiting embodiment, this second step is also effected manually by an operative. In accordance with this second step, the operative rotates the heatsink 30 by hand.

The guide fins 300 therefore pivot about the rotation axis Ax, which is an axis defined by the pivot connection formed by the assembly comprising the slide 201 and the male pivot pin. The arrow a2 indicates the direction of rotation of the guide fins 300.

The heatsink 30 therefore pivots until it arrives at a so-called horizontal position This pivoting makes it possible to adjust the heatsink 30 and therefore makes it possible to move the first cut-off beam 101 along a horizontal axis Y-Y' (of the screen E shown in FIG. 3) so that at least one part (here 101A) of the cut-off beam 101 reaches the reference position P.

FIG. 9 shows the assembly of the optical module 10 to the support plate 20 in accordance with a third assembly step.

In one nonlimiting embodiment, this third step is also effected manually by an operative. In accordance with this third step, the operative assembles the optical module 10, here with its reflector 100, to the heatsink 30. The arrow a3 indicates the assembly direction, which is perpendicular to the surface of the printed circuit board 305.

It will be noted that the printed circuit board 305 has been assembled beforehand, either to the heatsink 30 at the location 307 that is dedicated to it or to the optical module 10 itself.

FIG. 10 shows the assembly of the heatsink 30 to the support plate 20 in accordance with a fourth assembly step.

In one nonlimiting embodiment, this fourth step is effected by a machine.

This step makes it possible to fine-adjust the position of the first cut-off beam 101 produced by the optical module 10 to the reference position P described above by means of the two first interface areas 302.

To effect this step, the light sources of the two optical modules 10 and 40 are lit so that they produce the first cut-off beam 101 and the second cut-off beam 401, respectively. In one nonlimiting embodiment, the light sources are lit successively so as to observe clearly the alignments of the cut-offs of the cut-off beams 101 and 401.

In this way, the machine will be able to superpose the portion 101*a* of the first cut-off beam 101 on the portion 401*a* of the second cut-off beam 401 with the required tolerance.

It will be noted that in one nonlimiting embodiment the machine may also use the additional interface areas 303 described above to effect a fine adjustment.

The arrows referenced a4 indicate this precise adjustment by the machine.

FIGS. 11 to 13 show the assembly of the heatsink 30 to the support plate 20 in accordance with a fifth assembly step.

In one nonlimiting embodiment, this fifth step is effected by a machine.

This step makes it possible to clamp the heatsink 30 to the support plate 20.

During this step, each fixing means 205 is inserted in the associated screw pillar 204 of the support plate 20 and into the dedicated aperture of the associated guide fin 300 of the heatsink 30.

In one nonlimiting embodiment, the fixing means 205 consist of a screw.

The guide fins 300 are therefore sandwiched between the cylindrical surfaces 200 and the fixing means 205, as shown in the FIG. 12 top view. The fixing means 205 apply a force so as to press the guide fins or rotational adjustment means 300 onto the cylindrical surfaces 200.

The fixing means 205 are also shown in the FIG. 13 rear view.

The heatsink 30 is therefore immobilized in position on the support plate 20 and therefore no longer has any mechanical play.

The assembly of the whole of the lighting module 1 is finished.

Of course, the description of the invention is not limited to the embodiments described above.

Accordingly, in one nonlimiting embodiment, the support plate 20 does not include any second surface 203.

Accordingly, in one nonlimiting embodiment, the cut-off of the first cut-off beam 101 is a lower cut-off.

In a nonlimiting variant embodiment, the cut-off of the first cut-off beam 101 is an entirely flat lower cut-off.

Accordingly, in one nonlimiting embodiment, the cut-off of the second cut-off beam 401 is a lower cut-off.

In a nonlimiting variant embodiment, the cut-off of the second cut-off beam 401 is an entirely flat lower cut-off.

Accordingly, in one nonlimiting embodiment, the first surface 200, the second surface 203 and the adjustment means 300 have a flat shape.

The invention described therefore notably has the following advantages:

it makes it possible to adjust in rotation the position of the heatsink 30 and therefore the position of the optical module 10 relative to the support plate 20, and consequently it makes it possible to adjust the first cut-off beam 101 with respect to a single given axis, here horizontal (the axis Y-Y' of the screen E);

this is a solution that is simple to implement and that does not necessitate a large number of mechanical parts to be assembled;

the assembly by a human operative is fast to carry out since they have fewer pieces to assemble than in the prior art described;

the clamping of the heatsink 30 is simple to carry out.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lighting module for automobile vehicles (V), including:

at least one optical module adapted to produce a first cut-off beam;

a support plate for a heatsink;

said heatsink adapted to receive said at least one optical module;

wherein:

said support plate includes a first surface;

said heatsink includes rotational adjustment means adapted:

to enter into contact with said first surface of said support plate; and to pivot about a particular rotation axis (Ax) so as to position said first cut-off beam produced by said at least one optical module at a reference position (P).

2. The lighting module according to claim 1, wherein said first cut-off beam is a cut-off beam at least one portion of which is flat.

3. The lighting module according to claim 1, wherein said rotational adjustment means include two fins for guiding said heatsink, notably distributed on respective opposite sides of cooling fins.

4. The lighting module according to claim 3, wherein said first surface and said rotational adjustment means are of cylindrical shape with a circular section.

5. The lighting module according to claim 1, wherein:

said support plate further includes at least one slide; and said heatsink further includes a male pivot pin adapted to be inserted in said at least one slide of said support plate.

6. The lighting module according to claim 1, wherein said heatsink further includes a first interface area adapted to cooperate with an adjustment tool so as to actuate the rotation of said rotational adjustment means about said rotation axis (Ax).

7. The lighting module according to claim 6, wherein:

said support plate further includes a surface provided with an aperture situated in front of said first surface; and said first interface area is disposed at a level of said aperture after the contact between said rotational adjustment means of said heatsink and said first surface of said support plate.

8. The lighting module according to claim 6, wherein said heatsink further includes an additional interface area adapted to cooperate with an adjustment tool so as to actuate the rotation of said rotational adjustment means about said rotation axis (Ax).

9. The lighting module according to claim 1, wherein:

said support plate further includes a screw pillar; and a fin for guiding the said heatsink is further adapted to receive fixing means inserted in said screw pillar of said support plate.

10. The lighting module according to claim 1, wherein said support plate further includes a second surface facing said first surface, said first surface and said second surface forming a groove for guiding said rotational adjustment means for rotational adjustment of said heatsink.

11. The lighting module according to claim 1, wherein said support plate is further adapted to receive an additional optical module adapted to produce a second cut-off beam.

12. The lighting module according to claim 11, wherein said second cut-off beam is a cut-off beam a portion of which is oblique.

13. The lighting module according to claim 11, wherein said reference position (P) corresponds to a horizontal part of said second cut-off beam.

14. The lighting module according to claim 11, wherein said first cut-off beam and said second cut-off beam are adapted to provide conjointly a first low beam photometric function (f1).

15. The lighting device for automobile vehicles (V) including a lighting module according to claim 1.

16. The lighting module according to claim 2, wherein said rotational adjustment means include two fins for guiding said heatsink, notably distributed on respective opposite sides of cooling fins.

17. The lighting module according to claim 2, wherein:
said support plate further includes at least one slide; and
said heatsink further includes a male pivot pin adapted to be inserted in said at least one slide of said support plate.

18. The lighting module according to claim 2, wherein said heatsink further includes a first interface area adapted to cooperate with an adjustment tool so as to actuate the rotation of said rotational adjustment means about said rotation axis (Ax).

19. The lighting module according to claim 7, wherein said heatsink further includes an additional interface area adapted to cooperate with an adjustment tool so as to actuate the rotation of said rotational adjustment means about said rotation axis (Ax).

20. The lighting module according to claim 2, wherein:
said support plate further includes a screw pillar; and
a fin for guiding said heatsink is further adapted to receive fixing means inserted in said screw pillar of said support plate.

* * * * *